United States Patent [19]

McMillan et al.

[11] 4,264,264

[45] Apr. 28, 1981

[54] LOADER MOUNTING STRUCTURE

[75] Inventors: John R. McMillan; Mervin P. Kizlyk, both of Welland, Canada

[73] Assignee: Deere & Company, Moline, Ill.

[21] Appl. No.: 14,871

[22] Filed: Feb. 26, 1979

[51] Int. Cl.[3] ..... E02F 3/62

[52] U.S. Cl. ..... 414/686; 37/117.5

[58] Field of Search ..... 414/686, 723, 607; 37/117.5; 172/272, 274

[56] References Cited

U.S. PATENT DOCUMENTS

| | | | |
|---|---|---|---|
| 2,614,712 | 10/1952 | Dingley | 414/686 |
| 2,851,238 | 9/1958 | Harrington | 172/272 X |
| 3,934,738 | 1/1976 | Arnold | 414/723 |

OTHER PUBLICATIONS

Koyker Loader; Koyken Manufacturing Co.; Hull, Iowa 51239.

Farm Loader Model 470; Allis-Chalmers.

*Primary Examiner*—Stephen G. Kunin

*Assistant Examiner*—Terrance L. Siemens

[57] ABSTRACT

Structure for detachably mounting a loader to a tractor or other mobile vehicle. An upright pedestal is carried at the rearward end of each loader boom arm for positioning in a receiving support carried on respective sides of the vehicle. Guide and following surfaces provided between the lower portions of each pedestal and support facilitate quick, positive engagement of the pedestal with its support. A transverse pin at the lower end of each receiving support provides a pivotable support for a downwardly opening bracket which is carried on each pedestal and is guided onto the pin by the guide and following surfaces. Engagement of the bracket on the pin horizontally locates the pedestal relative to the support and vertically positions alignable and releasable fastening structure carried between each pedestal and support. In the preferred embodiment, positioning surfaces engageable between the pedestal and support force the bracket vertically onto the pin and restrain the pedestal against upward vertical movement. An adjustable bolt is carried on the support and engages the pedestal to locate its horizontal position relative to the support and assure horizontal alignment of the fastening means.

8 Claims, 6 Drawing Figures

LOADER MOUNTING STRUCTURE

BACKGROUND OF THE INVENTION

The present invention relates generally to power loaders adapted for mounting on tractors and is more particularly related to the structure provided between such a loader and tractor to permit one man to quickly and easily mount or dismount the loader.

Front end power loaders are commonly used on tractors and other mobile vehicles as attachments. When the loader is not to be utilized, it is dismounted and stored since it can interfere with the effectiveness of the tractor in other operations. Because loaders are often required for short durations and at infrequent intervals, the structure provided to mount and dismount them from the tractor can directly affect the operator's productivity as well as the use of the tractor.

Many loaders currently available are coupled to the tractor by bolts or plates which require significant time and effort to attach or remove them. A more convenient mounting structure utilizes upstanding tractor mounted supports at each side of the engine compartment which receive upstanding side frames that are pivotally carried by the loader lift boom arms. These side frames remain with the loader apparatus and are secured to the tractor mounted supports in order to mount the loader onto the tractor. To mount the side frames, the tractor is advanced between the loader lift boom arms and the hydraulic hoses are coupled with the tractor. The lift boom arm hydraulic cylinders are then activated to swing the side frames into the receiving supports and position the lower portion of each side frame in the support. Once the lower portion is positioned, the upper portion of the side frame is secured to the tractor support and the loader is ready for use.

While these structures are much more convenient than those which bolt to the tractor or to plates mounted on the tractor frame, they nevertheless are provided with positioning structures which must be engageably aligned and locking mechanisms which must be secured to fix them in place. These positioning and locking mechanisms often times make mounting or dismounting difficult and time consuming and can frequently require that two or more individuals be available.

One commonly available mounting structure provides upper and lower transverse openings on both the supports and the side frames. The openings must be aligned as the side frame is positioned into the support so that pins can be inserted to secure the side frame with the support. Frequently, alignment is difficult and requires more than one man to manipulate the hydraulic controls, assure that alignment occurs and insert the pins into the openings. Additionally, small hand tools are generally required to insert the pins in the openings or remove them.

Another currently available mounting structure utilizes a downwardly projecting stub on the side frame of the loader which must be inserted into a receivable opening contained in the support structure to position the side frame. The upper portion of the side frame is then swung rearwardly into the support and openings in the side frame and support must be aligned to permit a pin to be inserted to lock the side frame in its support. This stub structure is often difficult to position precisely. Alignment of the openings often is difficult as well and insertion and removal of the pin are often time consuming. With this structure also, two men are often times required to assure precise positioning of the stub in the opening, precise alignment of the openings and quick coupling of the frame with the support.

SUMMARY OF THE INVENTION

The present invention overcomes these problems and provides a mounting structure designed to permit one man to quickly, simply and easily mount or dismount a loader to a tractor without the use of small hand tools.

The improved mounting structure in the preferred embodiment includes a transverse pivot carried at the lower portion of a tractor mounted support member, a bracket on the lower portion of the loader carried side frame that is guided by engageable surfaces into engagement with the pivot, locates the frame relative to the support member and prevents horizontal and downwardly vertical movement of the side frame relative to the support, engageable positioning surfaces between the side frame and support, vertically spaced from the pivot and bracket, for forcing the bracket into position and vertically onto the pivot when engaged, adjustment means between the frame and support member for horizontally locating the upper portion of the frame relative to the support member, and releasable locking means between the side frame and support member to secure the positioning surfaces in engagement and prevent vertical movement of the side frame relative to the support member.

This mounting structure permits one man to manipulate the lift arm hydraulic cylinder on the loader to swing the bracket carried at the lower end of the side frame onto the transverse pivot of the support member and locate the lower portion of the side frame relative to the support member. Guide and following surfaces between the side frame and support slidably position the bracket onto the pivot as it is vertically adjusted to permit one man to position the side frame in the receiving support member. The positioning surfaces force the bracket down and onto the pivot to positively locate the side frame relative to the support member and locate openings in the side frame and support member through which a locking pin is inserted. The adjustable bolt permits the side frame to be horizontally adjusted relative to the support member when first mounted to insure that the pin openings align in subsequent mountings.

DESCRIPTION OF THE PREFERRED EMBODIMENT

Figure 1:
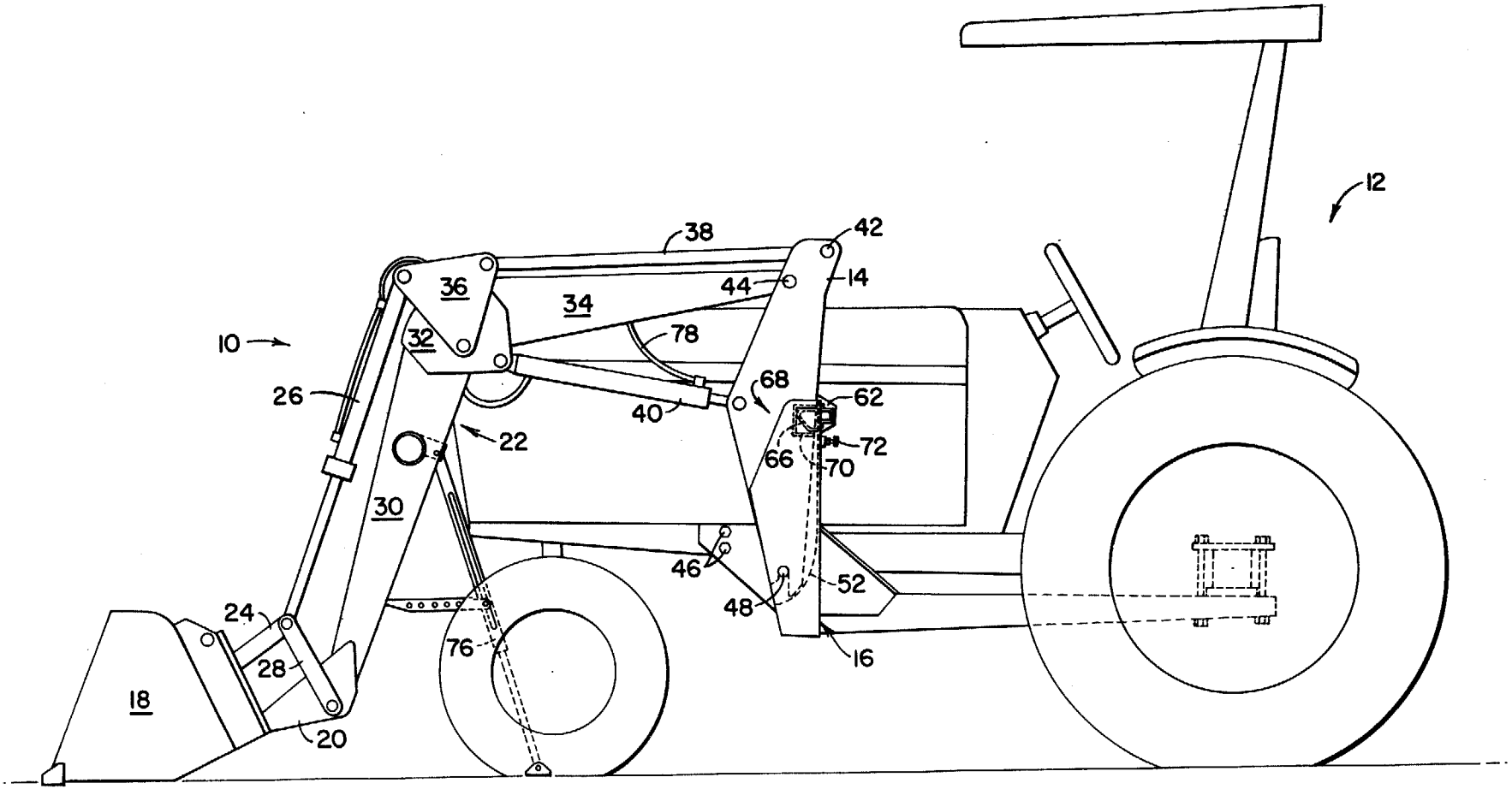
FIG. 1 is a side view of a tractor and loader utilizing the improved mounting structure.

Looking now to FIG. 1, there is illustrated a power loader indicated in its entirety by the reference numeral 10. While the mounting structure is illustrated in combination with a tractor 12, it will be understood that it can be utilized with other mobile units such as track-laying vehicles.

In the following description, only one side frame 14 and side frame receiving member 16 will be discussed since each side of loader 10 and its mounting structure have identical components for securing the loader to each side of the tractor 12. The material-handling device 10 illustrated in FIG. 1 is typical of many loaders and includes a working tool in the form of a bucket 18. The bucket 18 is swingably coupled at its lower rear edge with the transversely spaced lower mast members 20 which are carried by the loader boom arms 22. Near its top and rear edge portion, the bucket 18 is pivotally connected to a pair of upper control links 24 that in turn are connected to the end of a hydraulic tilt control cylinder 26. The tilt control cylinder 26 is also pivotally coupled to a downwardly extending lower control link 28 that has its other end swingably coupled with the lower mast arm 20.

The loader boom arm 22 is composed of the lower arm 30 rigidly connected by plates 32 to a rearwardly extending lift arm 34. A bell crank 36 is pivotally coupled with plates 32 at the juncture between the lower arm 30 and lift arm 34 and has its outer corners pivotally connected to the tilt control cylinder 26 and a rearwardly extending lift link 38. A lift cylinder 40 has its base end pivotally mounted to the plate 32 and its ram end pivotally coupled with the upright structure or side frame 14.

The side frame member 14 is pivotally connected at its upper portion by vertically spaced pivots 42 and 44 respectively to the lift link 38 and lift arm 34. Through the vertically spaced pivotal connections with the lift arm 34, lift cylinder 40 and lift link 38, the side frame 14 can be swingably manipulated both vertically and horizontally in a fore-and-aft extending plane to position it within or remove it from the forwardly opening U-shaped receiving support 16.

Figure 3:
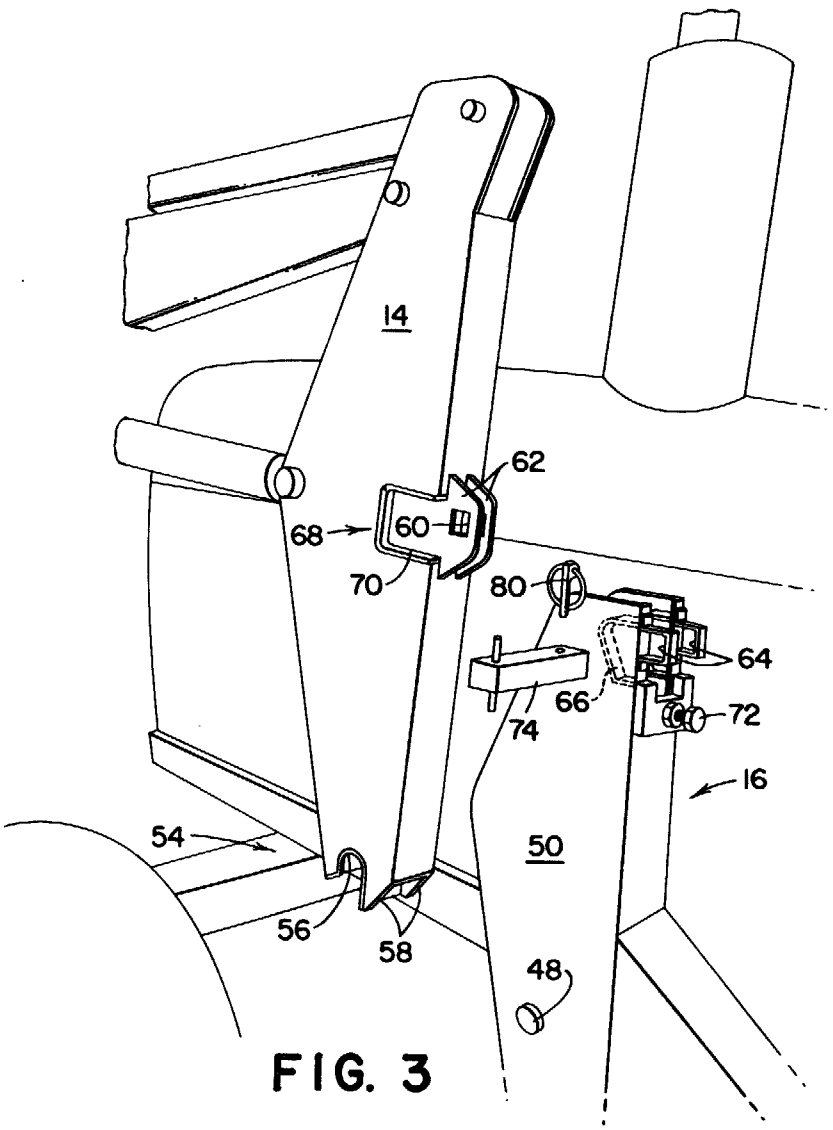
FIG. 3 is an expanded rear perspective view of the loader side frame that is mounted in the support member.
Figure 2:
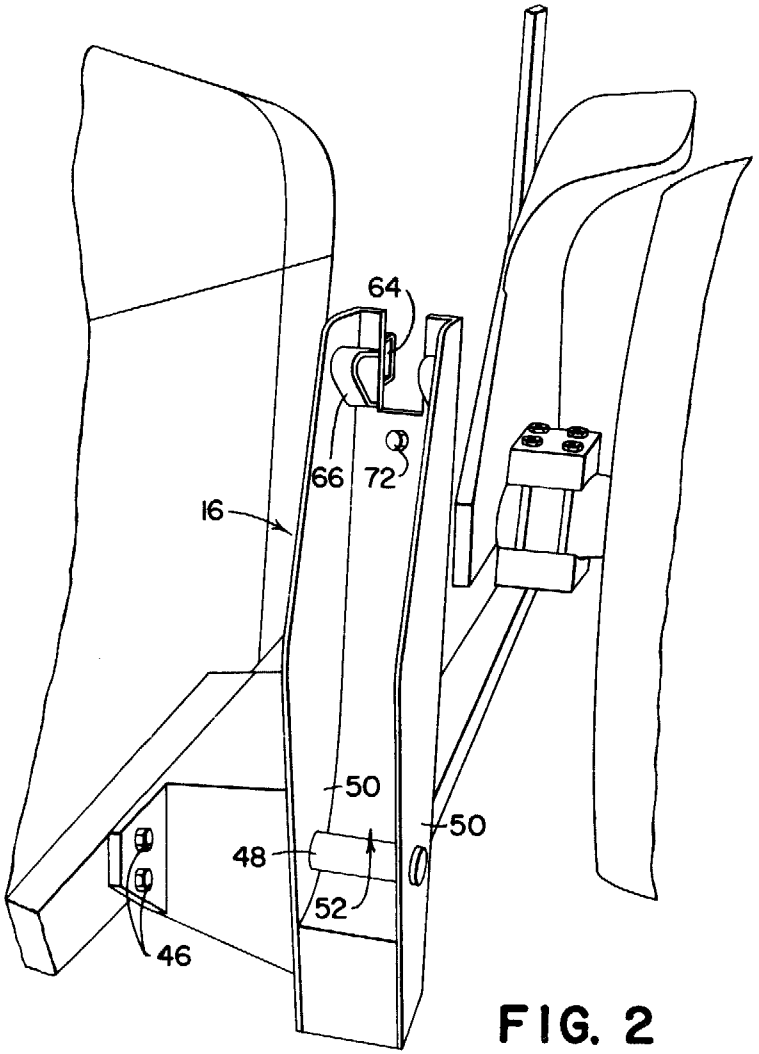
FIG. 2 is an expanded front perspective view of the loader support member carried by the tractor.

The tractor 12 carries one receiving member or support 16 on each side of the engine area. This member 16 and the side frame 14 are best illustrated in FIGS. 2 and 3. The receiving member 16 opens to the front to receive the side frame 14. It is rigidly secured to the tractor frame by bolts 46 or other satisfactory means. The lower portion of the receiving member 16 supports a transversely extending locating pivot structure 48. This structure is in the form of a pin supported between upwardly extending sides 50. It is forwardly spaced of the upwardly and rearwardly inclined wall or base 52 of member 16.

Figure 6:
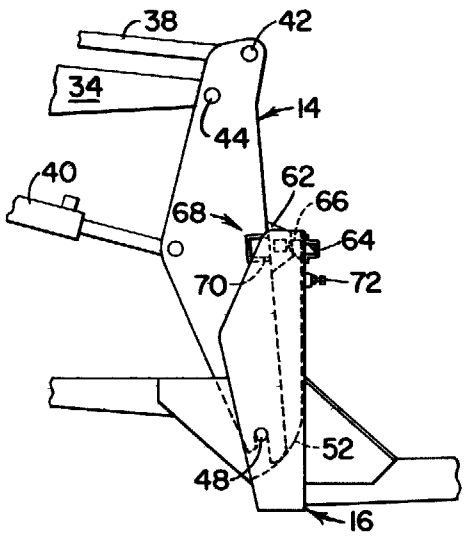
FIGS. 4, 5 and 6 are sequential side views of a loader side frame being positioned in a receiving support member.

At the lower end of the side frame 14 (see FIG. 3) is carried a vertically opening bracket 54 which is engageable with the pivot pin 48 to locate the lower end of the frame member 14 relative to the receiving member 16 and support it in the receiving member 16. This bracket 54 includes a downwardly opening recess having an abutment surface 56 against which another abutment surface or pin 48 is seated. Rearwardly of this recess and the surface 56 is an inclined following surface 58 that engages the inclined wall or guide surface 52 of the receiving member 16 to guide the bracket 54 onto the pin 48 as it is vertically shifted within the receiving member 16. After the bracket 54 has engaged and is supported on the pin 48, as illustrated in FIG. 6, horizontal and downwardly vertical movement of the side frame 14 relative to the receiving member 16 is restricted by the side walls 50 of the member 16 the downwardly projecting sides of the bracket 54 and the pin 48.

An engageable positioning or camming means can be further provided between the side frame 14 and receiving member 16 to precisely, vertically locate the side frame 14 relative to the receiving member 16 and align the openings 60 in the rearwardly projecting fins 62 of the side frame 14 with the openings 64 carried on the rear side of the receiving member 16. The positioning means is composed of the camming surfaces 66 carried by the walls 50 of the receiving member 16 vertically spaced above the pivot pin 48 and the generally horizontal surfaces 68 recessed in the sides of the side frame member 14. The camming surfaces 66 of the receiving member 16 are inclined from front to rear to force the lower horizontal surface 70 of the side frame member 14 downwardly as it slidably engages the surfaces 66 of the receiving member 16. As the side frame 14 is swung about the pin 48, this locating means forces the pedestal or frame 14 downwardly and the transverse surfaces 56 of the bracket 54 are seated onto the pivot pin 48, precisely and positively locating the side frame 14 vertically relative to the receiving member 16.

The openings 60 and 64 are thus vertically aligned as the bracket 54 positively engages the pivot pin 48. To assure horizontal alignment of the openings 60 and 64, an adjustable bolt 72 is provided in the receiving member 16, see FIGS. 2 and 3. After the bracket 54 is seated onto the pin 48 and the surfaces 66, 68 are engaged, the bolt 72 can be advanced to abut the back surface of the side frame member 14 and position it relative to the rear wall of the receiving member 16. This adjustment generally must be made only after the first mounting of the loader 10 onto the tractor 12 to establish fore-and-aft horizontal alignment of the openings 60 in the side frame 14 with the openings 64 carried in the receiving member 16.

To secure the side frame 14 in the receiving member 16, a retaining pin 74 is inserted through the openings 60 and 64. This can generally be accomplished manually and without the use of hand tools due to the assured positioning realized when the bracket 54 is seated on the pin 48 and the pedestal 14 is swung back to abut the bolt 72. The camming or positioning means further assures that the bracket 54 is positively seated and that the openings 60, 64 of the locking means are aligned.

To mount a loader 10 supported on its bucket 18 and parking stand 76, the operator first advances the tractor 12 between the boom arms 22 to position the side frame members 14 in front of their respective receiving members 16. The hydraulic cylinder hoses 78 are then connected to the tractor's hydraulic outlets to enable the operator to swingably manipulate the side frames 14 into their respective receiving members 16. This swinging manipulation is best illustrated in the sequence of drawings numbered FIGS. 4, 5 and 6.

Figure 5:
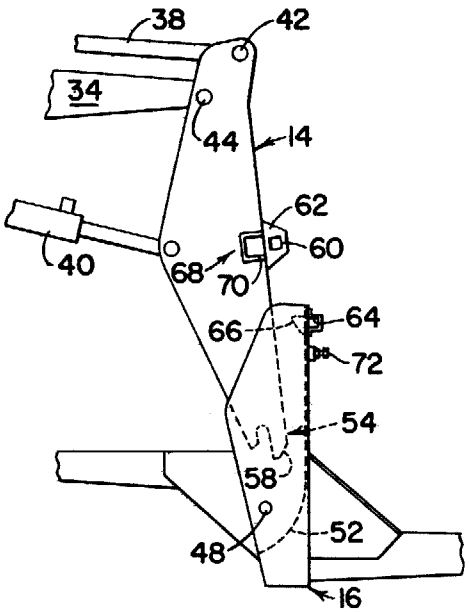
Figure 4:
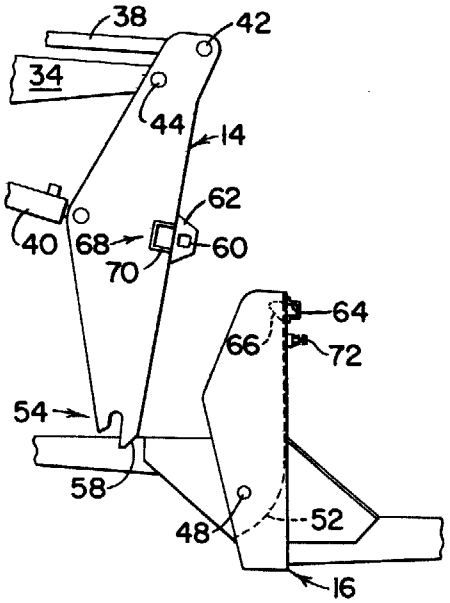

In FIGS. 4, 5 and 6, it will be seen that the operator initially positions the side frames 14 into the receiving members 16 through first extending the lift cylinder 40 and pivoting the side frame 14 about the lift arm 34 to swing the bracket 54 rearwardly.

The bucket tilt cylinder 26 is then extended to vertically lower the side frame 14 and engage the bracket 54 with the pivot pin or trunnion means 48. As the side frame 14 is lowered, the following surface 58 contacts the guide surface 52 of the receiving member 16 to slidably guide the bracket or trunnion-receiving means 54 onto the transverse pivot pin 48. The engaged bracket 54 and pivot pin 48 will restrict fore-and-aft horizontal movement and downward vertical movement of the side frame 14 and the walls 50 of the receiving member 16 will restrict transverse movement of the side frame member 14.

To restrict upwardly vertical movement of the side frame 14, the operator must then swingably rock the top portion of the side frame 14 rearwardly about the pivot pin 48 from the position illustrated in FIG. 6 to that position illustrated in FIG. 1 so that the locking pin 74 can be inserted into the openings 60, 64. To further assure proper alignment of the openings 60, 64 as the side frame 14 is swung rearwardly, the lower horizontal surfaces 70 will slidably abut against the rearwardly and downwardly inclined surfaces 66 on the receiving member 16 to force the bracket 54 vertically downwardly onto the pivot pin 48 and restrict upwardly vertical movement of the side frame 14.

The side frame 14 can be easily locked in place by the operator without hand tools. He need only insert the retaining pin 74 through the openings 60 and 64 and then insert the cotter key 80 through the pin 74 to prevent it from slipping out of the openings 60 and 64.

We claim:

1. Means for detachably securing a material-handling device to a mobile vehicle comprising:

an upright structure carried by the device, said structure having spaced apart first and second portions;

a structure receiving support secured on at least one side of the vehicle;

alignable locking means carried between the first portion of said structure and the support;

engageable abutment means carried between the second portion of said structure and the support, for positioning said second portion relative to the support and limiting its movement and for positioning the locking means in vertical alignment;

engageable guide and following surfaces between the structure and support for slidably bringing the abutment means into engagement; and adjustment means carried between the structure and support for positioning the locking means in horizontal alignment.

2. The invention further defined in claim 1 wherein the guide and following surfaces include downwardly and forwardly inclined surfaces on the support and the structure.

3. A material-handling device for use on a mobile vehicle, said device having lift arms on opposite sides of the vehicle, the improvement residing in means between the vehicle and lift arms to detachably mount the device to the vehicle comprising:

an upright frame member carried on each lift arm, each frame member having spaced apart first and second portions;

an upright frame-receiving member supported on each side of the vehicle;

locking means alignable between the first portion of each frame member and its respective receiving member;

engageable abutment means carried between the second portion of each respective frame member and receiving member for positioning the second portion relative to the support and limiting its movement when engaged and for positioning the locking means in vertical alignment, each abutment means including a transversely extending pivot structure on one member and a vertically opening bracket carried by the other member for engagement with the pivot structure;

engageable guide and following surfaces between each frame and respective receiving member for slidably bringing the opening of each bracket into engagement with its pivot structure;

camming means between each frame and receiving member, spaced from said pivot structure and bracket and effective when slidably engaged to force the bracket onto the pivot structure and restrict vertical movement of the bracket away from said pivot structure; and adjustment means carried between said members for positioning the locking means in horizontal alignment.

4. The invention defined in claim 3 wherein each bracket includes downwardly projecting surfaces to seat on opposite lateral sides of its respective pivot structure and each receiving member includes upright surfaces at each end of its transverse pivot structure to abut with the bracket when engaged with the pivot structure, said bracket surfaces and upright surfaces acting to restrict horizontal movement of the frame member relative to the receiving member.

5. The invention defined in claim 3 wherein the guide and following surfaces are inclined for vertically and horizontally shifting the respective frame member upon engagement of said surfaces to cause engagement of the bracket with the pivot structure.

6. In the combination of a material-handling device adapted for use on a mobile vehicle, said device having lift arms on opposite sides of the vehicle, the improvement residing in means between the vehicle and lift arms to detachably secure the device to the vehicle comprising:

an elongated upright frame member pivotally connected to each lift arm;

an elongated upright frame member receiving member having upper and lower portions supported on each side of the vehicle;

engageable support means between the lower portion of each frame member and its respective receiving member including a transversely extending pivot on one member and a vertically opening bracket on the other member engageable with the pivot, said support means restricting horizontal and downwardly vertical movement of the frame member when engaged;

guide and following means between each frame member and its respective receiving member for slidably positioning the opening of said bracket onto the pivot as the frame member is vertically shifted;

locating means engageable between the upper portion of each frame member and its respective receiving member for vertically locating the upper portion of the frame member relative to its respective member upon swinging movement of the frame member about the pivot and for preventing vertical movement of the bracket relative to the pivot;

releasable locking means between each frame member and its respective receiving member for maintaining engagement of the locating means; and adjustment means between the upper portion of each frame member and its respective receiving member for horizontally locating the upper portion of the frame member relative to its receiving member.

7. The invention defined in claim 6 wherein the receiving member carries an adjustable member abutable with the frame member to adjust the relative horizontal position of said frame member with respect to the receiving member.

8. In the combination of a tractor adapted to support a material-handling device having a working tool, laterally spaced and horizontally extending lift boom arms supporting said tool, upright side frame members pivotally connected to each boom arm and power means extending between each boom arm and side frame member for swingably moving the latter relative to the former; an improved means for detachably mounting the material-handling device on the tractor comprising:

a pair of upright supports secured to the tractor, each support having lower and upper U-shaped portions opening forwardly, the base of the lower U-shaped portions inclined from vertical;

a laterally extending pivot member carried in each lower U-shaped portion, forwardly of the inclined base;

a bracket carried by each side frame member, said bracket including a downwardly opening recess having a transverse surface engageable with the pivot member of its respective support;

an inclined guide surface carried between the sides of each upper U-shaped portion;

first and second following surfaces on each side frame member, engageable respectively with a respective guide surface and inclined base;

releasable fastening means between each side frame member and its respective support; and adjustment means between each side frame member and the upper portion of its respective support for horizontally locating the frame member relative to said upper portion.

* * * * *